United States Patent [19]

Griffiths

[11] Patent Number: 4,553,632

[45] Date of Patent: Nov. 19, 1985

[54] AUTO-LEVELED CRANE BOOM MAN BASKETS

[76] Inventor: Edward E. Griffiths, 3200 Polaris St. #23, Las Vegas, Nev. 89102

[21] Appl. No.: 597,500

[22] Filed: Apr. 6, 1984

[51] Int. Cl.[4] ..... B66F 11/04; G08B 21/00

[52] U.S. Cl. ..... 182/2; 182/19; 340/685

[58] Field of Search ..... 182/2, 19, 18; 340/685; 116/303

[56] References Cited

U.S. PATENT DOCUMENTS

| | | | |
|---|---|---|---|
| 2,772,411 | 11/1956 | Cooper | 182/19 |
| 3,590,948 | 7/1971 | Milner | 182/2 |
| 3,791,484 | 2/1974 | Harrison | 182/2 |
| 3,860,088 | 1/1975 | Gellatly | 182/2 |
| 4,116,304 | 9/1978 | Durnell | 182/2 |

*Primary Examiner*—Reinaldo P. Machado
*Attorney, Agent, or Firm*—Linval B. Castle

[57] ABSTRACT

An automatic leveling device for crane boom supported work baskets includes a weighted and damped plumb sensor coupled to a first potentiometer and a second potentiometer for measuring the relative angle between the crane boom and the basket pivotally attached thereto. The measured output levels of the two potentiometers are applied to a servo circuit that controls a linear power actuator pivotally attached between the boom and basket to thereby maintain the basket vertical. The basket may be electrically isolated from ground for use on "live" wire maintenance when the basket carries a storage battery for powering the servo and actuator and if the basket controls for boom movement are transmitted to the crane through a fiber optic or radio remote control link.

6 Claims, 2 Drawing Figures

AUTO-LEVELED CRANE BOOM MAN BASKETS

BRIEF SUMMARY OF THE INVENTION

This invention relates generally to attitude control of the so-called "cherry picker" man baskets used for making repairs and installations on utility poles or the like, and particularly to a novel self-contained automatic leveling system expressly valuable for use on live high voltage lines because no electrical conductor is coupled between the grounded crane and a basket mounted upon a fiberglass or otherwise insulated crane boom.

It is obvious that a fully insulated basket is required for electrical maintenance operations upon live conductors, such as the changing of fractured insulators, installation of parallel conductors, installation of new utility poles, etc. Such maintenance is conducted with work baskets mounted upon strong insulated fiberglass crane booms the positioning of which being controlled by the crane operator at ground potential. Normally, such baskets are supported at the end of an insulated boom by a yoke or a single axis gimbal ring which may be manually tightened by the basket technician to secure the basket in a vertical working position and then later loosened to free the movement of the basket when the boom is to be lowered.

In operations requiring precise positioning of a man basket or frequent position changes it is usually most desireable to turn full control of the boom over to the basket technician. If electrical isolation from ground is required, the boom positioning controls may be operated from the basket through one of the many types of nonconductive fiber-optic or radio remote control links. But vertical position changes alter the basket angle and require continuous releasing and retightening of the yoke axis to assure that the basket remains reasonably vertical. One important problem is thus presented. When the yoke axis is released in preparation for a vertical position change, position changes of personnel, tools, etc. within the basket often causes the basket to pitch at an alarming angle, thereby causing the personnel and tools to slide to the lowest level in the basket and thereby increase the pitch angle and possibly resulting in a fall from the basket.

This inventon overcomes the abovementioned problems and provides automatic means permitting a smooth and positive basket angle correction to the vertical irrespective of load positions within the basket.

Briefly described, the invention includes a servo system which accepts a first input signal from a potentiometer attached to a dampened plumb sensor and a second signal from a second potentiometer geared to the motor of a linear actuator that controls the basket angle. The servo generates from the error signal difference a D.C. output to the linear actuator which automatically and smoothly adjusts the basket angle to the vertical irrespective of off-center loading within the basket or vertical boom adjustments.

BRIEF DESCRIPTION OF THE DRAWINGS

In the drawings which illustrate the preferred embodiment of the inventon.

DETAILED DESCRIPTION

Figure 1:
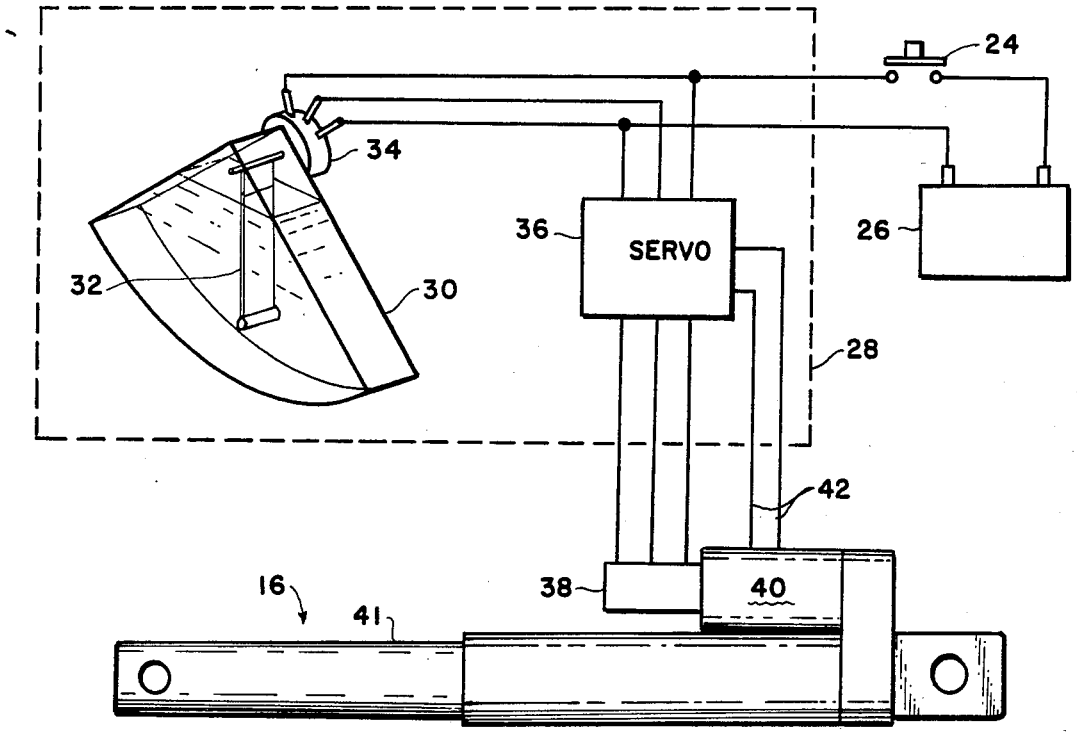
FIG. 1 is a schematic drawing of the circuitry associated with the man basket.
Figure 2:
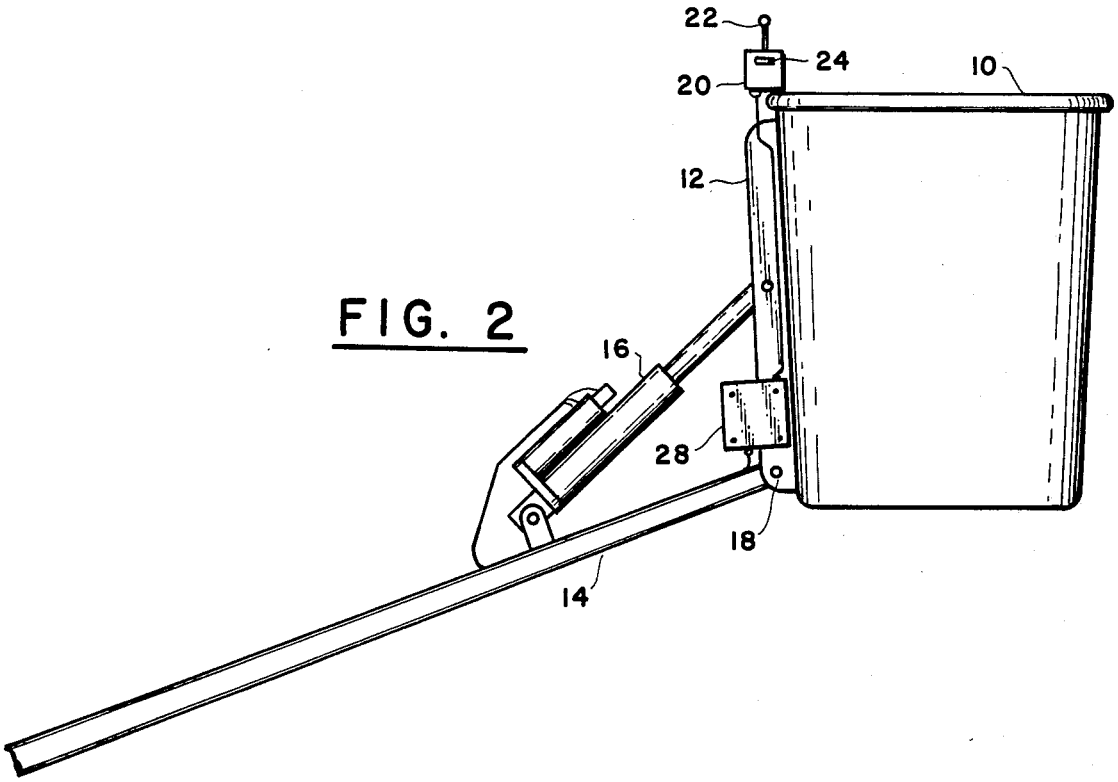
FIG. 2 is an elevation view illustrating the basket, the preferred mounting on the crane boom, and locaion of the various components.

As illustrated in the drawings, a "cherry-picker" type basket 10 for working at above-ground elevations has an attached supporting channel member 12 that is pivotally mounted at the lower end to the end of a crane boom 14. A linear power actuator 16 is pivotally connected between the top surface of the boom 14 and a point near the center of the member 12 so that linear contraction or expansion of the actuator will operate to tilt the basket on its lower pivot 18. The linear power actuator 16 is a commercially available component including a D.C. motor 40 gear driving a screw driven ram 41 which extends outward or withdraws back according to the rotational direction of the motor 40 and the polarity of the applied D.C.

A boom control box 20 is mounted to the top of the basket 10 and contains a boom control lever 22 which preferably controls a fiber optic or radio remote control transmitter in the box so that control signals may be transmitted by a fiber optic coupling to the boom controls in the supporting crane. The fiber optic control is preferred for electrical isolation of the basket which is preferably connected to an insulated fiberglass boom. The basket is therefore completely insulated from the crane and electrical ground references and may be used for maintenance on "live" high voltage lines.

The boom control box 20 also includes a switch 24 for enabling the automatic automatic basket leveling system of the invention. The basket 10 carries a D.C. storage battery 26, as illustrated in FIG. 1, for powering the linear power actuator 16. The switch 24 is a normally-off push button switch and is in the conductor from either one of the battery terminals so that battery power remains off until the switch 24 is closed. Electrical conductors between the control box 20 and a tilt sensor and servo circuitry housing 28 mounted to the channel 12 near the lower pivot 18 provide the necessary D.C. power to the automatic leveling system contained with the housing 28 and to the linear power actuator 16 that controls the tilt of the basket 10.

The sensor and servo contained within the housing 28 is illustrated within the dashed lines in FIG. 1 and includes a tilt sensor 30 comprising a sealed container of a slightly viscous fluid that either remains fluid at below freezing temperatures, or which may be heated to remain fluid by a small imersion heating element (not shown) that may be operated off of the battery 26 and through a conductor that bypasses the switch 24. The sensor container is preferably pie shaped with an inclined apex angle of approximately 90° and is mounted in the housing 28 with the apex pointing upward, as illustrated. The vertical inside length of the container is approximately four inches from apex to arcuate surface and the inside thickness is approximately one-half inch. A paddle 32 having a width of about one-quarter inch is connected to a lateral shaft that is pivotable on suitable bearings in the walls near the apex of the container and one end of the pivotable shaft extends through a wall and is coupled to a potentiometer 34. A small weight is attached to the lower of the paddle to assure that the paddle remains vertically aligned in the motion damping fluid in the housing.

The end terminals of the potentiometer 34 are coupled to the battery 26 through the normally open switch 24. The center terminal of the potentiometer 34 produces a D.C. output level that is normally half the battery potential but which varies according to the degree of swing of the weighted paddle 32 in the damping fluid. The center terminal of the potentiometer 34 is therefore coupled to a servo circuit 36 which compares the D.C. voltage level on the center terminal of the potentiometer 34 with a second voltage level from the center terminal of a second potentiometer 38 which is geared to the motor 40 of the linear actuator 16 and which provides an accurate indication of actuator extension and therefore the tilt angle of the basket 10. The servo circuitry 36 compares the signal levels from the potentiometers 34 and 38 and, upon detecting a difference in a signal level, will direct battery power to the actuator motor 42 at the appropriate polarity for rotating the motor to a position at which the basket is again level, or aligned upon a vertical axis.

In the preferred embodiment described, the second potentiometer 38 is attached through suitable gearing to the actuator motor 40 so that the potentiometer will produce a D.C. output that accurately indicates the tilt angle of the basket with respect to the boom axis. If preferred, the potentiometer 38 may be located in any other location that will produce the same results. For example, the potentiometer may be connected to the boom 14 with the potentiometer shaft connected for rotation with a pivot pin at the basket lower pivot point 18 to thereby measure relative angles between basket and boom.

The basket leveling system has been described in its preferred embodiment for use in live high voltage areas and thus completely insulated from ground potential. If the basket is not needed for such environments, the crane or truck boom 14 may be a steel boom and the battery 26 may be eliminated from the basket 10 and the truck battery power may be brought to the basket through conventional power cables coupled to the boom.

In operation, basket operator normally has full boom control through the control lever 22 to raise, lower, or swing the booom and basket to either side. If the boom is to be raised or lowered, the operator need only depress the spring biased, normally-open switch 24 on the boom control box 20 to enable the automatic basket leveler to assure the basket remains on a vertical axis irrespective of the changes in elevation angle of the boom.

Having thus described the invention, what is claimed is:

1. An automatically leveled man basket for attachment to the end of a crane boom, such as an electrically insulated crane boom for electrical isolation from ground, said basket including:

a D.C. power source at the basket;

first pivoting means pivotally mounting a lower end of the basket to the end of the boom a D.C. powered linear power actuator pivotally connected to said boom and to a second pivoting means on the side surface of said basket for tilting said basket around said first pivoting means;

a gravity controlled tilt sensor attached to said basket, said sensor including a fluid chamber containing a weighted paddle the upper end of which is coupled to a horizontally supported rotatable shaft;

a first potentiometer coupled to said rotatable shaft and said D.C. power source for producing an output signal representing the angle of said weighted paddle from the vertical;

a second potentiometer coupled to said D.C. power source and positioned for producing an output signal representing the angle of tilt of said basket about said first pivoting means; and servo circuitry responsive to the output signals of said first and said second potentiometers for applying electrical power of appropriate polarity to said power actuator.

2. The automatically leveled man basket claimed in claim 1 wherein said linear power actuator is a motor driven screw actuator extended and retracted by the polarity of D.C. power applied thereto.

3. The man basket claimed in claim 2 wherein said second potentiometer is geared to said linear power actuator motor for providing an electrical indication of tilt angle of said basket around said first pivoting means, and wherein said servo circuitry compares the signal levels from said first and said second potentiometers to derive an error signal that controls the polarity of D.C. applied to said linear power actuator motor.

4. The man basket claimed in claim 3 wherein said crane boom is electrically nonconductive and said basket contains a battery for supplying D.C. power to said servo circuitry and to said linear power actuator motor.

5. The man basket claimed in claim 4 further including a manually operable, normally open, switch in series between said battery and said servo circuitry and power actuator motor.

6. The man basket claimed in claim 1 wherein said gravity controlled tilt sensor includes a fluid chamber containing a light, viscous, anti-freeze fluid for damping the movement of said weighted paddle.

* * * * *